US007226052B1

(12) United States Patent
Scibetta

(10) Patent No.: US 7,226,052 B1
(45) Date of Patent: Jun. 5, 2007

(54) TOWER BOARD GAME

(76) Inventor: Joseph Scibetta, 6 Ferncliff Rd., Jersey City, NJ (US) 07305

( * ) Notice: Subject to any disclaimer, the term of this patent is extended or adjusted under 35 U.S.C. 154(b) by 0 days.

(21) Appl. No.: 11/476,385

(22) Filed: Jun. 28, 2006

(51) Int. Cl.
*A63F 3/00* (2006.01)

(52) U.S. Cl. ..... 273/239; 273/241; 273/287

(58) Field of Classification Search ..... 273/241, 273/287, 239; 473/256
See application file for complete search history.

(56) References Cited

U.S. PATENT DOCUMENTS 5,775,697 A * 7/1998 Snarli ..... 273/274
6,220,597 B1 4/2001 Scibetta
6,394,452 B1 * 5/2002 Dunne ..... 273/241
6,626,433 B2 9/2003 Scibetta
7,114,720 B1 * 10/2006 Whitehurst ..... 273/241

* cited by examiner

*Primary Examiner*—Vishu Mendiratta
(74) *Attorney, Agent, or Firm*—Bradley N. Ruben

(57) ABSTRACT

A game board where players move their pieces vertically upwards simulates competition in an industry structure, climbing the corporate ladder. Players start with numbered cards and investment wagers, the highest card winning a turn and advancing up the board and winning the others' investments. Players achieve advantages, such as money and the ability to have additional cards in their hand, at predetermined vertical levels along the board. The loser of the turn, the lowest card, must take an action card having incumbent good or bad results. All others advance less than the winner. The game winner has the most money.

19 Claims, 2 Drawing Sheets

FIG_1
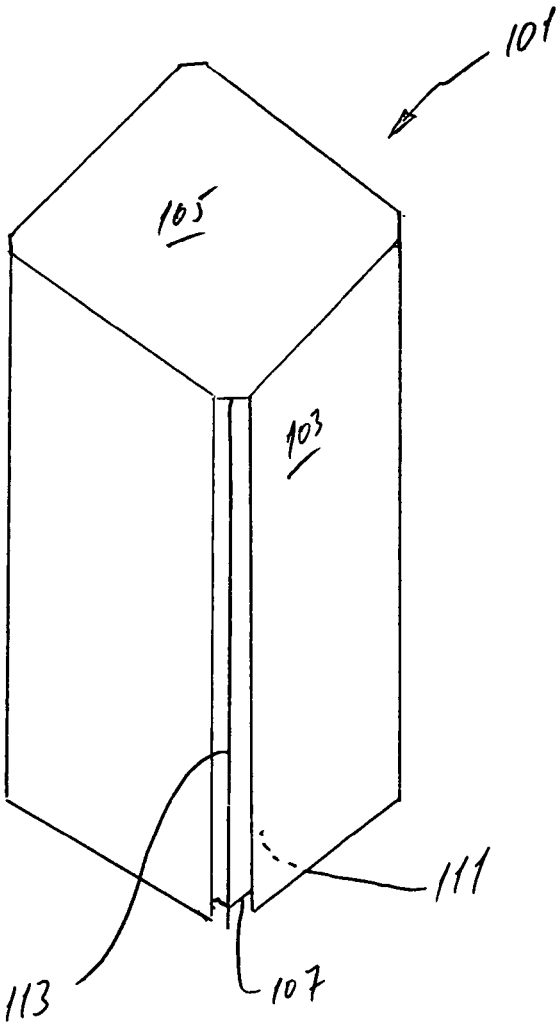
FIG_4
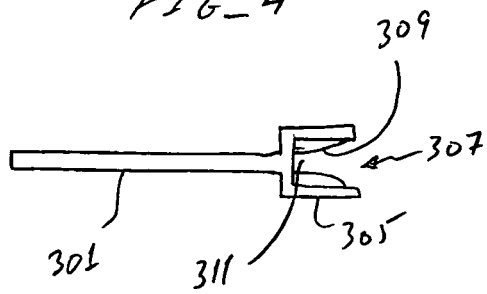
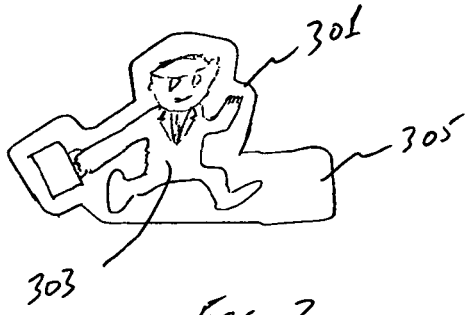
FIG_3
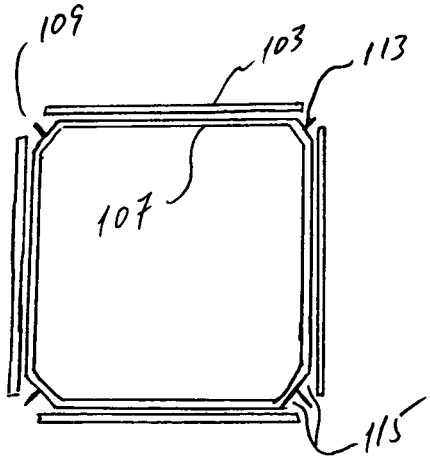
FIG_2

TOWER BOARD GAME

BACKGROUND OF THE INVENTION

This invention relates to a game having a playing board in the form of a tower and simulating advancement in an industry.

The prior art is replete with board games using cards and pieces identifying players moved on a game board. Players are dealt and/or choose cards that determine how their pieces move on the board. Indicia where the player lands on the board determines any additional actions or fate of the player. Some board games have the player make a continuous circuit with the goal being to accumulate "money" or points, whereas other have a goal the player must reach to win the game. These games can provide simulations of life in general (finding a job, starting a family) or of industry (accumulating and using assets). There are also card games that are, or can be adapted to simulate an industry-type advancement game.

SUMMARY OF THE INVENTION

This invention provides an industry-type advancement game where the board is vertical, preferably three-dimensional, simulating the rise in a company (the "corporate ladder"), including player pieces that are positioned in various vertical positions on the board, and devices (cards and optionally chips) for determining the moves made.

An advantage is that the game board includes an internal cavity in which all of the game pieces and devices can be stored.

BRIEF DESCRIPTION OF THE DRAWINGS

FIG. 1 is a perspective view of the tower game board.

FIG. 2 is a bottom view of the game board.

FIG. 3 is a side view of a game piece.

FIG. 4 is a top view of a game piece.

DETAILED DESCRIPTION OF SPECIFIC EMBODIMENTS

Figure 5:
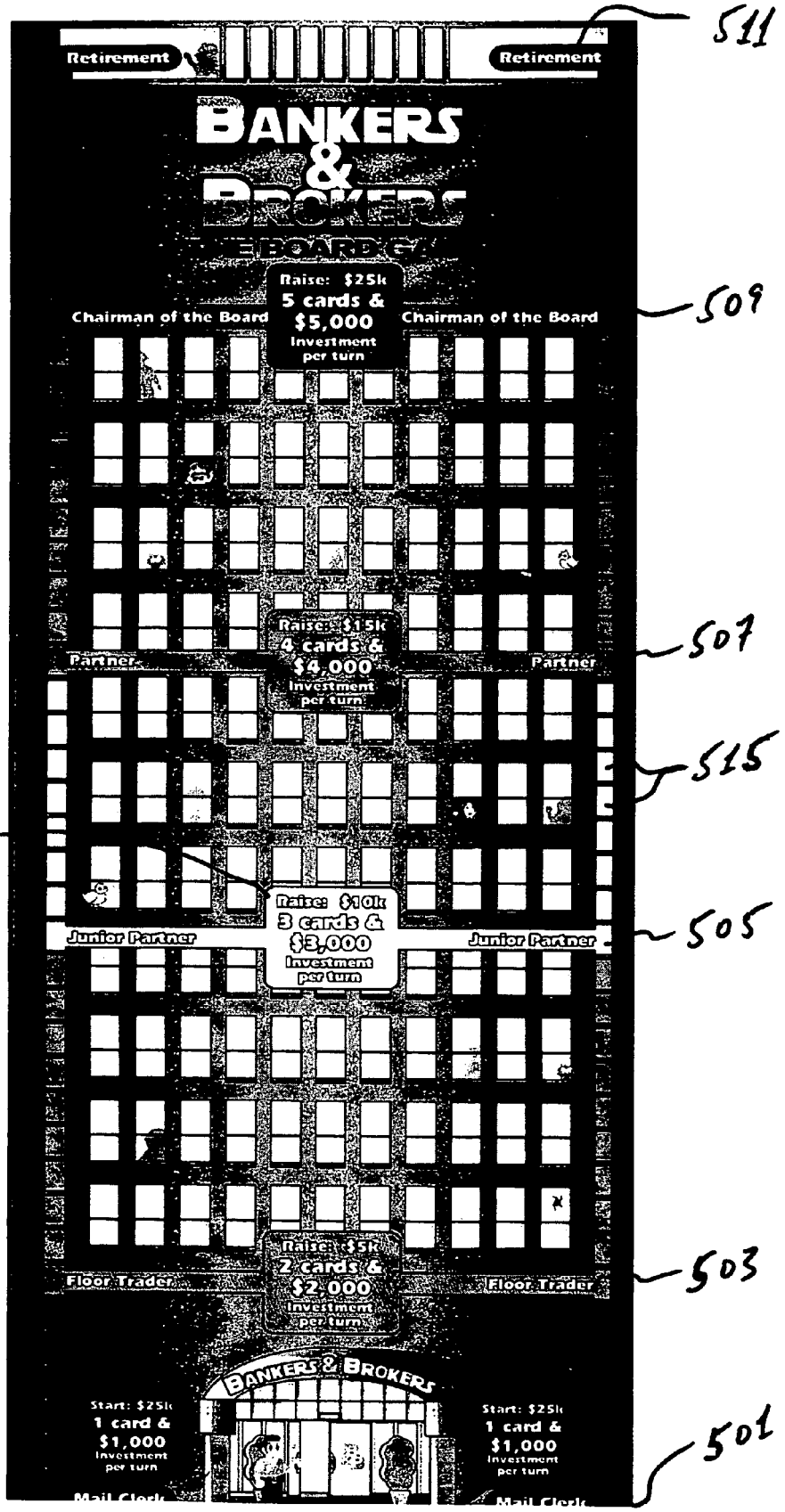
FIG. 5 is a plan view of a wall of the tower game board with the game indicia.

As seen in FIGS. 1 and 2, perspective and bottom views, respectively, the game board is in the form of a rectangular tower in the preferred embodiment. Any other regular or irregular polygon can be used, or the tower can even have curved walls, so long as the game pieces described below, or equivalents thereof, can be used. The board 101 includes side walls 103 and a top 105 with an open bottom 111. The walls are preferably paperboard or other printable material. The walls are attached (preferably by an adhesive) to the frame 107. The frame is preferably made of a moldable plastic (e.g., polystyrene such as HIPS or GPPS) and if a plastic is chosen that is easily printed upon, then the wall indicia (described below) can be printed directly on the frame without the need for separate side walls. The plastics used herein for the board and the game pieces are preferably thermoplastic.

In the embodiment show, the side walls to not meet at the corners but instead are separated to provide an opening 111 through which a player piece retaining means, an edge wall 113 extending from the frame into the opening; there are openings 115 on both sides of the edge wall as it extends from the bottom opening to the top along one corner of the tower. In the right rectangular embodiment shown, each corner has the same structure; use of a different polygon can use a similar structure with an edge wall at each vertex (viewed from above or below the vertices of the polygon being visible).

An example of a game piece is shown in FIGS. 3 and 4, respectively side and top or bottom views thereof. The body 301 of the game piece preferably has indicia unique for that game pieces compared with the other pieces used in the game, and as shown can have a perimeter approximating the outline of the graphical indicia 303 identifying that game piece. Integral with the body is a tongue 305, having an opening 307 and preferably ribs 309 extending into the opening to provide an effective opening 311 surrounded by the gripping surfaces of the ribs. In use, the piece is removably attached to the edge wall by fitting the wall into the effective opening. Thus, the piece can be removably positioned at any vertical position on the tower.

FIG. 5 depicts the indicia on each of the side walls. In the embodiment described herein, the game simulates a corporate ladder in a brokerage and/or bank: the first level 501 is a Mail Clerk; the next higher level 503 is a Floor Trader; the next higher level 505 is a Junior Partner; the next higher level 507 is a Partner; the next higher level is the Chairman of the Board; and the next higher and highest level 511 is Retirement. Of course, the indicia shown can be adapted for any industry (such as a law firm (e.g., mail clerk to senior partner) or a hospital (e.g., orderly through chief of the hospital)). The indicia preferably also includes certain game instructions 513, in this embodiment the "raise" acquired when achieving that level, the minimum amount of money that must be played at any turn, and the number of cards to be taken at each turn. As these indicia apply to all players, each of the side walls has the same indicia. Preferably, each level is uniquely color coded in comparison with the other levels.

The game preferably also includes two decks of playing cards and chips (like poker or casino chips, or other pieces indicating monetary value) for wagering. One deck comprises action cards, identifying an action taken and a result (such as having to pay money, making money, losing a turn, and the like; for example, going to Las Vegas for a convention but instead going to gamble and losing, and so forfeiting money into the game; or that you have been demoted and must retreat a certain number of spaces on the board towards the first level; or that a stock investment has worked and you earn money from the sale in the game). Accordingly, the action result can include getting or paying money, something affecting your turn (e.g., losing one or more turns or being demoted), or an action you can take against another player (e.g., advancing or swapping with that player's position, or demoting the player, or getting a promotion). The second deck comprises "playing cards", cards having numbers thereon. It is preferred to include in the playing cards one or more jokers.

The object of the game as embodied is to be the player with the most money at the end of the game. The game ends when the players decide to end the game (if multiple players still have money left), and otherwise could continue indefinitely. Each player begins at the first level (Mail Clerk) and must work their way up to making more money. Preferably the board is placed in the middle of a table with each player (up to 4 in this embodiment) facing a side wall. Because the player pieces stick out from the board, it is possible to see how high up other players have advanced. However, the object is not necessarily Retirement, as will be seen.

The action cards are shuffled and placed face down, preferably on the top wall.

The playing cards are shuffled and spread out face down to all of the players until no cards are left (or a complete deal cannot be completed). Each play thus has a "draw pile" of cards from which that player can draw one or more playing cards.

Each player is given a fixed amount of money to start. If chips are used (preferably two or three colors, such as red, white, and blue, representing, respectively, $5000, $1000, and $10,000 for each chip), each player can be given $25,000 to start the game (one blue chip, two red chips, and five white chips). Of course, paper money can also be used.

The first turn begins with each player drawing a playing card from his (or her) draw pile, investing (or wagering) according to their level (as shown in FIG. 5, Mail Clerk is a $1000 minimum investment), and then simultaneously turning over the playing card drawn. The player exposing the (numerically) highest playing card advances a given number of spaces (two) up the board by adjusting the placement of the player piece on the edge wall. As shown in FIG. 3, the side wall indicia also simulates an office building with spaces 515 for each level indicated on both sides adjacent the edge wall. The player with the highest playing card exposed also collects all of the money invested by the other players. The player(s) exposing playing cards having values between the highest value and the lowest value move up one space (or any positive number of spaces fewer than the highest player is allowed to move). The player with the lowest exposed value for the playing card must choose one of the action cards. The playing cards are then discarded into a common discard pile.

Various rules can be established for "ties" for any hand. If two or more players expose the same highest value for the playing card, it is preferred that each advance only one space and the investment (wager) is rolled into the next turn; alternatively, they could split the investment, or merely take back their own investment amount with the remainder rolling over to the next turn. If two or more players have the lowest playing card value exposed, each must draw an action card; alternatively, each could also be required to invest the same amount again in addition to picking an action card.

The play continues in this fashion, with each player choosing a playing card, investing according to their level on the board, simultaneously exposing their chosen playing cards, and the highest taking the investments and advancing with the lowest taking an action card.

As seen in FIG. 3, as players advance up the board their position changes, and the minimum amount invested increases, and each gets to choose more cards from the draw pile, with the investments and number of cards allowed in their hand (drawn from the draw pile) increasing progressively as the player moves up the board. As each player advances to a new level, that player also gets a "raise", an amount of money for reaching that level; the raises similarly increase progressively.

In another embodiment, the playing card deck includes one or a few jokers, a "power play" card. Such a card can have the highest value, and/or it can allow a player to switch the position of their player piece with another player's piece (e.g., so that the two players effective trade places, a "power play"). In another embodiment, while the player moving up by changing places could get the raise for that level or for all levels, it is preferred that the player not accumulate those intermediate raises, but must draw the number of playing cards and invest according to the requirement of their newly swapped present level. If a player is demoted (through an action card) or swapped to a lower level, that player must also forfeit cards in his hand if necessary to have the number of cards allowed for that level.

If a player cannot pay his debts or does not have enough money to invest, then that player either loses or must start their piece at the first level, where he receives the initial money amount ($25,000 in the example above).

If a player moves up to the highest level, Retirement, that player totals his chips and is out of the game until the end.

A player reaching the second highest level, Chairman of the Board, preferably has the added ability to pass debts or other obstacles obtained from drawing an action card to a player of his choice, or to a given player (e.g., the next closest player).

It is seen that there are various strategies for winning. A player can achieve the second highest level (Chairman) and purposely throw low cards if the investments can be afforded while keeping the positive outcomes of the action cards and foisting the undesired outcomes of the action cards on other players. Once a player is allowed to have at least two cards in his hand, he can save the "power play" card and, after reaching Chairman, swap positions with the lowest player and earn all of the raises all over again. A player or groups of players colluding can throw low cards to try and force the Chairman into retirement; in this example, a joker could be provided that is automatically the lowest card, or the rules can provide that the "power play" card can be the highest or the lowest card, at the player's option during a given turn.

As seen from FIGS. 1 and 2, the board preferably has a cavity accessible through the bottom opening. The player pieces, chips, and cards can be stored in this cavity. A closure can be provided, such as a lid with an outer perimeter just smaller than the inner perimeter of the opening that frictionally fits into the opening.

In another embodiment, the edge walls is made of a (ferro)magnetic material and the tongue portion of the player pieces is a magnet so that the pieces can be positioned and removably retained magnetically.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A board game kit, comprising:

a board having top and bottom polygonal perimeters, an open bottom, a top wall closing the top perimeter, and a plurality of side walls with game indicia thereon and supported on an internal frame, said internal frame defining an inner volume accessible through said open bottom, and said internal frame spanning the top and bottom perimeters, defining said bottom opening, and supporting said side walls and said top wall, retaining means disposed between corresponding edges of adjacent side walls for retaining a game piece at a predetermined locations along the edge, and at least two player pieces removably attachable to the retaining means;

a deck of action cards;

a deck of playing cards; and devices representing money.

2. The board game kit of claim 1, wherein the playing cards include at least one joker.

3. The board game kit of claim 1, wherein the devices representing money are chips of different colors.

4. The board game kit of claim 1, wherein the game indicia are provided on paperboard adhered to the frame.

5. The board game kit of claim 1, wherein the game indicia are printed directly on the frame.

6. The board game kit of claim 1, wherein the player pieces frictionally attach to the retaining means.

7. The board game kit of claim 1, wherein the player pieces magnetically attach to the retaining means.

8. The board game kit of claim 1, further comprising a cavity inside the board wherein said player pieces, deck of action cards, deck of playing cards, and devices representing money are stored within said cavity.

9. A method for playing a game, comprising:

providing (a) a game board having a vertical extent defined by at least three sides each with identical game-playing indicia and means for retaining the player pieces at a desired vertical position along the retaining means disposed adjacent abutting sides, (b) playing cards having numerical values, (c) action cards, (d) at least two player pieces, and (e) devices indicating money, wherein each player plays on one of the sides;

dealing the playing cards face down to all players to produce an individual draw pile for each player;

providing each player with an initially equal amount of money via the devices;

each player drawing a card from the individual draw pile and then wagering (investing) a minimum amount into a pot;

all players simultaneously turning over the card drawn from the draw pile, with the player having highest value playing card advancing up the retaining means by a first amount and taking in the investments from all of the players, the player having the lowest value picking an action card and following instructions thereon, and all other players advancing up the retaining means by an amount less than the first amount.

10. The method of claim 9, wherein all of the players start at the bottom.

11. The method of claim 10, wherein upon reaching each of one or more predetermined locations upwards along the vertical extent of the retaining means each such player gains an advantage.

12. The method of claim 11, wherein such player receives money.

13. The method of claim 11, wherein each such player is allowed to retain in their hand an increased number of cards from the individual draw pile.

14. The method of claim 11, wherein the game indicia includes indications of said locations.

15. The method of claim 11, wherein the game indicia includes the minimum investment for each location for each turn.

16. The method of claim 9, wherein the playing cards include one or more jokers.

17. The method of claim 16, wherein the joker is the highest or the lowest card for a given turn at the player's choice.

18. The method of claim 9, wherein the game indicia includes space indicators adjacent the retaining means.

19. The method of claim 9, wherein the game indicia includes the number of playing cards a player can retain in his hand.

* * * * *